United States Patent [19]

Ince

[11] 4,349,074

[45] Sep. 14, 1982

[54] CONVERTIBLE ROTARY IMPACT HAMMER DRILL

[75] Inventor: Norman J. Ince, Hampton, England

[73] Assignee: Kango Electric Hammers Limited, London, England

[21] Appl. No.: 158,382

[22] Filed: Jun. 11, 1980

[30] Foreign Application Priority Data

Jun. 18, 1979 [GB] United Kingdom ..... 7921151

[51] Int. Cl.[3] ..... B25D 11/12

[52] U.S. Cl. ..... 173/48

[58] Field of Search ..... 173/118, 48, 104

[56] References Cited

U.S. PATENT DOCUMENTS 3,114,423 12/1963 Naslund ..... 173/48 X
3,791,461 2/1974 Rosselet ..... 173/48
4,114,699 9/1978 Wolf ..... 173/118 X
4,131,165 12/1978 Wanner et al. ..... 173/48
4,232,749 11/1980 Rohrbach ..... 173/48

*Primary Examiner*—Werner H. Schroeder
*Assistant Examiner*—Andrew M. Falik
*Attorney, Agent, or Firm*—Wenderoth, Lind & Ponack

[57] ABSTRACT

In a rotary hammer drill in which a tool is driven in rotation by rotating the cylinder housing a driver piston and a striker, the hammering effect is rendered inoperative by providing in the well of the barrel an aperture which is axially positioned so as to vent the space between the driver and striker to the atmosphere. A sleeve is mounted on the external surface of the barrel and is axially movable to blank off the aperture or to place it in communication with the ambient atmosphere.

3 Claims, 4 Drawing Figures

CONVERTIBLE ROTARY IMPACT HAMMER DRILL

This invention relates to rotary hammer drills and is more particularly concerned with rotary hammer drills having selectively-operable means permitting the hammering to be rendered inoperative.

Electric hammer drills are required to provide a rotary drive for rotating the tool being driven and also a reciprocatory drive which is converted into a hammering action on the tool being driven. In one common form of such an electric hammer drill, a cushion of air trapped between the reciprocatory drive means and the tool being driven transmits the hammering action. In order to convert the operation of the drill from a combined drilling and hammering action to a simple drilling action, it is necessary to either avoid the creation of the cushion of air, or to vent the cushion of air.

Prior art devices, such as shown in U.S. patents such as U.S. Pat. Nos. 3,114,423 and 4,114,699 have accomplished this result by providing special chucks or tools with shortened shanks, so that the action of a piston on the downstream end of the air cushion does not strike the end of the shank so as to transmit hammering action thereto.

However, in both of these devices, in order to convert the operation of the device, it is necessary to stop the device and change the tool or the tool chuck.

It is an object of the present invention to provide means for converting the operation of a hammer drill from a combined hammering and drilling action to a simple drilling action, and vice versa, by a simple means for venting the air cushion through which the hammering action is transmitted.

To this end, there is provided a sleeve mounted on the outside of the cylinder which contains the air piston, and which covers and uncovers a vent aperture in this sleeve as it is moved between a first position and a second position along the cylinder by a manually operated means such as a knob with an eccentric pin thereon.

According to this invention there is provided a rotary hammer drill comprising a rotary holder for a drill bit, a cylinder which is rotatably mounted in the casing of the drill and which is coaxial with and drivingly connected to the holder, a driver piston and a striker piston in the cylinder, a motor-driven crank and connecting rod mechanism connected to reciprocate the driver piston in the cylinder, the striker piston being free for reciprocatory movement in the cylinder under the influence of the pressure of air trapped between the two pistons and being arranged to strike an anvil axially slidably disposed between the striker piston and the holder whereby hammer blows are transmitted to the holder, an aperture being formed in the cylinder wall at a location between the two pistons and beyond the position at which the aperture can be closed off by the driver piston, a sleeve mounted on the outside of the cylinder which sleeve is axially slidable between a first position in which the sleeve covers the aperture and prevents the passage of air into and from the cylinder through the aperture and a second position in which the aperture is uncovered and places the space between the piston in communication with the ambient atmosphere, and manually operable means for selectively moving the sleeve into said first and second positions.

Some embodiments of the invention will now be described with reference to the accompanying drawings in which.

Figure 1:
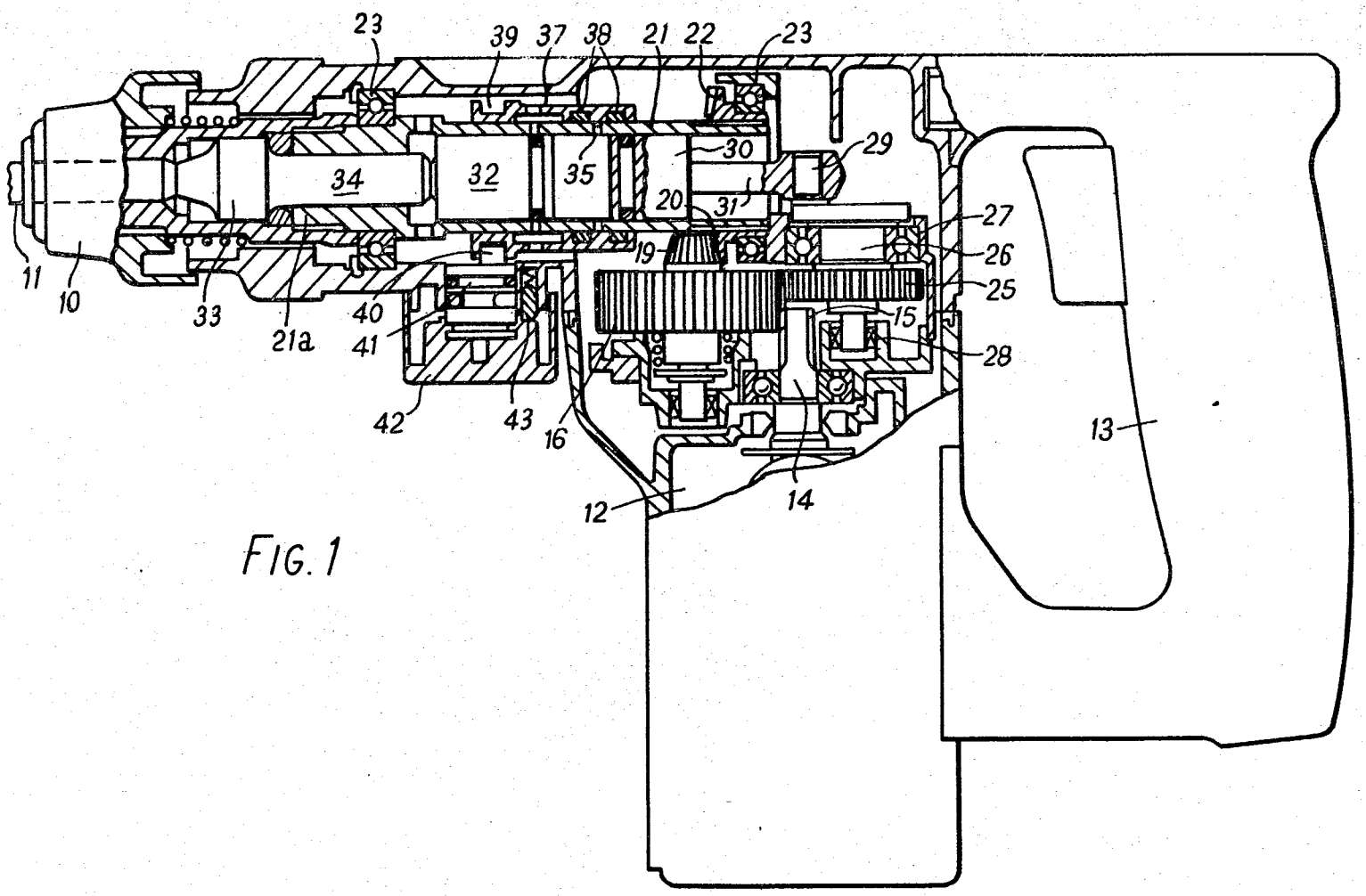
FIG. 1 shows an electric hammer, partly in axial section.
Figure 2:
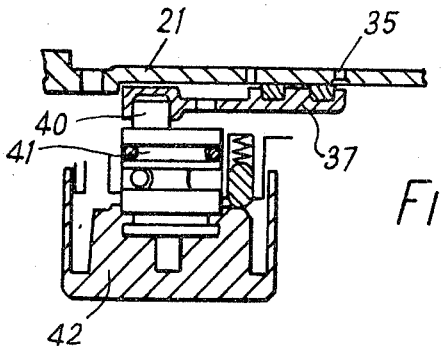
FIG. 2 shows the other operative position of the sleeve of the hammer of FIG. 1, and FIGS. 3 and 4 are respectively views of an alternative sleeve arrangement in its two operative positions.

Referring to FIGS. 1 and 2 of the drawings, there is shown a portable electric hammer drill equipped with a holder 10 for a drilling bit (not shown). The drill holder 10 is arranged to receive simultaneously a rotary drive and hammer blows. Both of these actions are transmitted to the drill holder from an electric motor 12 through respective drive mechanisms.

Motor 12 is mounted close to a handle 13 secured to the rear end of the drill casing and has its output shaft 14 extending at right angles to the axis of rotation of the holder. The output shaft is formed with gear teeth 15 which mesh with an annular first pinion 16 rotatably mounted on a collar (not shown) secured to the casing of the drill. A spindle 19 carrying a bevel gear 20 at one end extends coaxially through the pinion 16, and the pinion drives spindle 20 through an overload clutch mechanism. The bevel gear 20 meshes with the teeth of a bevel ring gear 22 splined on one end of a cylinder 21 of the striker mechanism. Cylinder 21 is rotatably mounted in bearings 23 carried in the casing and its forward end portion 21*a* has the tool holder screwed on to it, so that the motor drives the tool in rotation through gear teeth 15, pinion 16, the overload clutch, bevel gear 20 and cylinder 21.

The gear teeth of the first pinion 16 extend axially beyond the end of the motor shaft 14, permitting a second pinion 25 to mesh with pinion 16. Pinion 25 is secured on a short shaft 26 rotatably mounted in bearings 27, 28 in the casing, and the rotational axes of pinions 16 and 25 and of the motor shaft 14 are coplanar with each other and with the axis of rotation of the cylinder 21. It will be apparent that this arrangement enables the motor to be mounted nearer to the handle by a distance substantially equal to the pitch circle diameter of the motor shaft teeth 15 than if pinion 25 meshed with teeth 15 directly at a location diametrically opposite pinion 16. Owing to the weight of the motor, it is advantageous to bring its center of gravity as near to the hand grip as possible so as to improve the balance and handling of the drill. At the same time, the numbers of teeth on pinions 16 and 25 can be independently selected since neither number affects the other.

The shaft of pinion 25 carries a crank-pin 29 at its end remote from motor 12, and a driver piston 30 mounted for reciprocation in the rotary cylinder 21 is coupled to the crank-pin by a connecting rod 31. A striker piston 32 is slidably mounted in the forward end portion of the cylinder 21, and in the well known manner the air trapped between the driver and striker pistons 30, 32 caused the striker piston to follow the reciprocatory movement of the driver piston but slightly out of phase therewith. As anvil 33 axially slidably mounted in a bore in the holder has a reduced-diameter portion 34 projecting into the forward end 21*a* of the cylinder 21, and portion 34 is struck by the striker piston 32 during the forward movement of the latter and transmits the impacts to the adjacent end of the shank of the drilling bit 11.

In order to permit the drill to be used without hammering, apertures 35 are formed in the wall of the cylinder 21 and can be uncovered to place the airspace between pistons 30 and 32 in open communication with the ambient atmosphere by moving an external covering sleeve 37 axially forward.

The apertures 35 are disposed just forward of the forward extremity of reciprocating movement of the driver piston 30, and the sleeve 37 has disposed in grooves on its inner surface two axially spaced sealing rings 38 which form seals between the sleeve and the external surface of the cylinder 21 at axially opposite sides of the aperture 35 respectively when the sleeve is in its rearmost position as illustrated. The friction between the sealing rings and the sleeve and the cylinder cause the sleeve to rotate with the cylinder. At its forward end the sleeve has an external annular groove 39 which is engaged by an eccentric pin 40 mounted at one end of a short shaft 41 rotatably mounted in the casing of the drill. The opposite end of shaft 41 projects outside the casing and has secured on it a manually operable adjusting knob 42. A spring-loaded plunger 43 is mounted in a recess in the casing, and a surface on the underside of the knob has two shallow recesses spaced 180° apart about the axis of rotation of the knob and positioned for engagement by the plunger to locate the knob resiliently in its respective positions corresponding to the forward and rearward end positions of the sleeve 37. Thus, in the position of the sleeve shown in the drawing, apertures 35 are effectively sealed while 180° rotation of the knob 42 will move the sleeve forward to uncover the apertures 35 and render the striker piston inoperative. The plunger 43 also operates to restrict the extent of rotation of the knob to the requisite 180°.

We have also found that if close control of the diametral clearance between the sleeve and the barrel is exercised, the sealing rings 38 and their grooves can be omitted without loss of efficiency.

Figure 3:
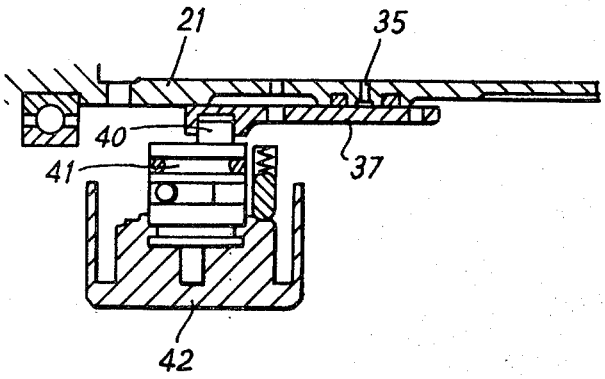
Figure 4:
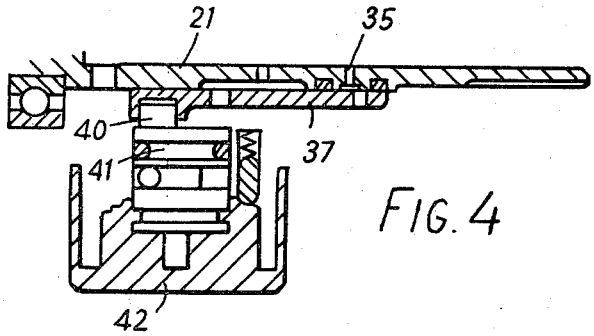

FIGS. 3 and 4, in which parts corresponding to those in FIG. 1 are indicated by the same reference numerals, show another form of construction in which the sealing rings are mounted in peripheral grooves in an external land on the barrel, the internal surface of the sleeve is cylindrical and slides on the land and a second land. The aperture 35 open to the external surface of the barrel between the two lands. The operation of the sleeve is as described in relation to the construction of FIGS. 1 and 2.

I claim:

1. A rotary hammer drill comprising a rotary holder for a drill bit, a cylinder which is rotatably mounted in the casing of the drill and which is coaxial with and drivingly connected to the holder, a driver piston and a striker piston in the cylinder, a motor connected to said cylinder for driving said cylinder in rotation, a crank and connecting rod mechanism connected to said motor and said driver piston to reciprocate the driver piston in the cylinder, the striker piston being free for reciprocatory movement in the cylinder under the influence of the pressure of air trapped between the two pistons and being arranged to strike an anvil axially slidably disposed between the striker piston and the holder whereby hammer blows are transmitted to the holder, an aperture being formed in the cylinder wall at a location between the two pistons and beyond the position at which the aperture can be closed off by the driver piston, a sleeve mounted on the outside of the cylinder which sleeve is axially slidable between a first position in which the sleeve covers the aperture and prevents the passage of air into and from the cylinder through the aperture whereby both rotary and axial movement is imparted to the drill bit and a second position in which the aperture is uncovered and places the space between the pistons in communication with the ambient atmosphere whereby only rotary movement is imparted to said bit, and manually operable means for selectively moving the sleeve into said first and second positions.

2. A rotary hammer drill as claimed in claim 1, wherein sealing rings forming a seal between the sleeve and the external surface of the cylinder are mounted in circumferential grooves on the external surface of the cylinder at opposite sides respectively of said aperture, said aperture communicating with ambient atmosphere, in said second position of the sleeve, through an aperture in the sleeve.

3. A rotary hammer drill as claimed in claim 1, wherein sealing rings forming a seal between the sleeve and the external surface of the cylinder are mounted in axially spaced grooves on the internal surface of the sleeve.

* * * * *